US006893331B2

(12) United States Patent
Huang et al.

(10) Patent No.: US 6,893,331 B2
(45) Date of Patent: May 17, 2005

(54) GIMBAL ASSEMBLY FOR SEMICONDUCTOR FABRICATION AND OTHER TOOLS

(75) Inventors: Wen-Jung Huang, Tainan (TW); Chin Hao Chang, Tainan (TW); Jaf Chen, Tainan (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/143,622

(22) Filed: May 9, 2002

(65) Prior Publication Data

US 2003/0211817 A1 Nov. 13, 2003

(51) Int. Cl.[7] ..... B24B 29/00
(52) U.S. Cl. ..... 451/288; 451/285; 451/287
(58) Field of Search ..... 451/288, 285, 451/287, 360

(56) References Cited

U.S. PATENT DOCUMENTS 4,941,293 A * 7/1990 Ekhoff ..... 451/342
5,762,544 A * 6/1998 Zuniga et al. ..... 451/285
6,086,457 A * 7/2000 Perlov et al. ..... 451/41
6,106,397 A * 8/2000 Phillips ..... 463/36
6,116,990 A * 9/2000 Sinclair et al. ..... 451/259
6,290,584 B1 * 9/2001 Kim et al. ..... 451/288
6,585,572 B1 * 7/2003 Saldana et al. ..... 451/67
6,602,121 B1 * 8/2003 Halley ..... 451/287
6,612,915 B1 * 9/2003 Uzoh et al. ..... 451/285

* cited by examiner

*Primary Examiner*—Joseph J. Hail, III
*Assistant Examiner*—Alvin J. Grant
(74) *Attorney, Agent, or Firm*—Tung & Associates

(57) ABSTRACT

A gimbal assembly that can be used in conjunction with semiconductor fabrication tools, such as chemical-mechanical polishing (CMP) tools, as well as other types of tools, is disclosed. A gimbal assembly may include a gimbal hub, a pivot head plate, a gimbal sleeve, and a gimbal post. The gimbal hub has an interior cavity. The pivot head plate has a ball head, a base, and an outer edge, where the base is situated in the bottom of the interior cavity. The gimbal sleeve is situated in the bottom of the interior cavity over the outer edge of the pivot head plate, securing the pivot head plate in place within the interior cavity. The gimbal post is situated over the ball head of the pivot head plate. The ball head of the pivot head plate preferably has dual diameters.

19 Claims, 5 Drawing Sheets

GIMBAL ASSEMBLY FOR SEMICONDUCTOR FABRICATION AND OTHER TOOLS

FIELD OF THE INVENTION

This invention relates generally to gimbal assemblies, and more particularly such gimbal assemblies as can be used in semiconductor fabrication tools.

BACKGROUND OF THE INVENTION

Chemical mechanical polishing (CMP) is a semiconductor wafer flattening and polishing process that combines chemical removal with mechanical buffing. It is used for polishing and flattening wafers after crystal growing, and for wafer planarization during the wafer fabrication process. CMP is a favored process because it can achieve global planarization across the entire wafer surface, can polish and remove all materials from the wafer, can work on multi-material surfaces, avoids the use of hazardous gasses, and is usually a low-cost process.

FIGS. 1A and 1B show an example of the effect of performing CMP. In FIG. 1A, a semiconductor wafer 102 has a patterned dielectric layer 104, over which a metal layer 106 has been deposited. The metal layer 106 has a rough top surface, and there is more metal than necessary. Therefore, CMP is performed, resulting in FIG. 1B. In FIG. 1B, the metal layer 106 has been polished down so that it only fills the gaps within the dielectric layer 104.

FIG. 2 shows an example of a CMP system 200 for polishing the wafer 102 of FIGS. 1A and 1B. The wafer 102, with its dielectric layer 104 and metal layer 106, is placed on a platen 202 connected to a rotatable rod 206. A polishing pad 204 is lowered over the wafer 102, specifically over the metal layer 106 thereof. The polishing pad 204 is also connected to a rotatable rod 206. Slurry 210 is introduced between the polishing pad 204 and the metal layer 106, and the polishing pad 204 is lowered, pressured against the metal layer 106, and rotated to polish away the excess, undesired metal from the metal layer 106. The platen 202 is rotated in the opposite direction. The combined actions of the two rotations and the abrasive slurry 210 polish the wafer surface.

The polishing pad 204 can be made of cast polyurethane foam with fillers, polyurethane impregnated felts, or other materials with desired properties. Important pad properties include porosity, compressibility, and hardness. Porosity, usually measured as the specific gravity of the material, governs the pad's ability to deliver slurry in its pores and remove material with the pore walls. Compressibility and hardness relate to the pad's ability to conform to the initial surface irregularities. Generally, the harder the pad is, the more global the planarization is. Softer pads tend to contact both the high and low spots, causing non-planar polishing. Another approach is to use flexible polishing heads that allow more conformity to the initial wafer surface.

The slurry 210 has a chemistry that is complex, due to its dual role. On the mechanical side, the slurry is carrying abrasives. Small pieces of silica are used for oxide polishing. Alumina is a standard for metals. Abrasive diameters are usually kept to 10–300 nanometers (nm) in size, to achieve polishing, as opposed to grinding, which uses larger diameter abrasives but causes more surface damage. On the chemical side, the etchant may be potassium hydroxide or ammonium hydroxide, for silicon or silicon dioxide, respectively. For metals such as copper, reactions usually start with an oxidation of the metal from the water in the slurry. Various additives may be found in slurries, to balance their pH, to establish wanted flow characteristics, and for other reasons.

FIG. 3 shows a CMP head assembly 300 that can act as the head assembly which rotates the polishing pad 204 of FIG. 2. The CMP head assembly 300 is specifically one that is manufactured by and available from the Lam Research Corp., of Fremont, Calif. A carrier head latch 302 is secured over a head assembly 304, which is connected to an outer assembly 306 via a nut 307 and a cell 309. A gimbal assembly made up of a gimbal post 308, a pivot head plate 310, and a gimbal hub 312 reside within an inner manifold 314 of a manifold that also includes an outer manifold 316. The outer manifold 316 is situated over the polishing head 318, and a carrier film 322 is secured to the polishing head 318 via a retaining ring 320.

FIGS. 4 and 5 show in more detail, as perspective and cross-sectional views, respectively, the gimbal assembly of FIG. 3 that includes the gimbal post 308, the pivot head plate 310, and the gimbal hub 312. The gimbal assembly permits the polishing head 318 to incline freely in all directions. This is because the gimbal post 308 is situated over the pivot head plate 310, and more specifically a ball of the pivot head plate 310. To ensure that the gimbal assembly allows this free movement of the polishing head 318, the base of the pivot head plate 310 is meant to securely and precisely plug into the gimbal hub 312, with the raised outer lip of the base of the pivot head plate 310 in particular securely and precisely positioned within the bottom of the interior cavity of the gimbal hub 312. That is, the raised outer lip of the base of the pivot head plate 310 is meant to ensure that the pivot head plate 310 cannot become loose once it is plugged into the gimbal hub 312.

However, this design of the gimbal assembly of FIGS. 4 and 5 is problematic. At least occasionally the base of the pivot head plate 310 is too tight to force into the interior cavity of the gimbal hub 312. This is because the base of the pivot head plate 310 must precisely fit within the interior cavity of the gimbal hub 312 to ensure that there is a secure fit between the two. However, occasionally the base of the pivot head plate 310 may be just wide enough that it cannot be forced into the interior cavity of the gimbal hub 312. As a result, the pivot head plate 310 may tilt within the gimbal hub 312, decreasing polishing uniformity of the CMP tool. Furthermore, even if there is a good, secure, and precise fit of the pivot head plate 310 in the gimbal hub 312 initially, over time the pivot head plate 310 may shake loose, since nothing is securing the pivot head plate 310 to the gimbal hub 312. This also decreases polishing uniformity of the CMP tool.

Therefore, there is a need for a gimbal assembly that overcomes these problems. With respect to gimbal assemblies generally, there is a need for such assemblies that ensure that the pivot head plate cannot shake loose from the gimbal hub. With respect to gimbal assemblies within semiconductor fabrication tools, such as CMP tools, there is a need for such assemblies that ensure polishing uniformity and thus proper semiconductor fabrication. For these and other reasons, there is a need for the present invention.

SUMMARY OF THE INVENTION

The invention relates to a gimbal assembly that can be used in conjunction with semiconductor fabrication tools, such as chemical-mechanical polishing (CMP) tools, as well as other types of tools besides semiconductor fabrication tools. A gimbal assembly of one embodiment of the invention includes a gimbal hub, a pivot head plate, a gimbal sleeve, and a gimbal post. The gimbal hub has an interior cavity. The pivot head plate has a ball head, a base, and an outer edge, where the based is situated in the bottom of the interior cavity of the gimbal hub. The gimbal sleeve is situated in the bottom of the interior cavity of the gimbal hub over the outer edge of the pivot head plate, securing the pivot head plate in place within the interior cavity of the gimbal hub. The gimbal post is situated over the ball head of the pivot head plate. The ball bead of the pivot head plate preferably has dual diameters, and the outer edge of the pivot head plate preferably does not have a raised lip.

Embodiments of the invention provide for advantages over the prior art. The gimbal sleeve secures the pivot head plate to the gimbal hub, without need for the pivot head plate to precisely fit snugly into the gimbal hub, such as via a raised lip. Tilt of the pivot head plate is therefore substantially eliminated for at least two reasons. First, the pivot head plate in the invention will likely always fit into the gimbal hub, unlike in the prior art. Second, because the gimbal sleeve is securing the pivot head plate to the gimbal hub, over time the pivot head plate is likely not to become loose and tilt, unlike in the prior art. As a result, where the gimbal assembly of the invention is used in conjunction with a semiconductor fabrication CMP tool, polishing uniformity is greater than in the prior art. Other advantages, embodiments, and aspects of the invention will become apparent by reading the detailed description that follows, and by referencing the attached drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims. For instance, whereas the invention is substantially described in relation to a gimbal assembly for a semiconductor fabrication chemical-mechanical polishing (CMP) tool, it is applicable to other semiconductor fabrication tools, and other tools other than semiconductor fabrication tools, as well.

Figure 1A:
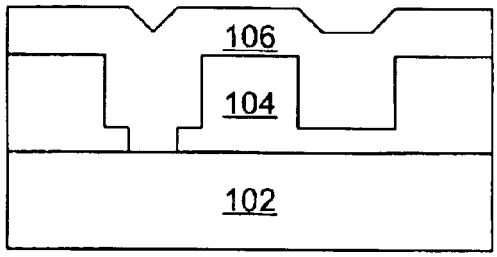
FIGS. 1A and 1B are diagrams showing an example of a chemical mechanical polishing (CMP) semiconductor fabrication operation.
Figure 1B:
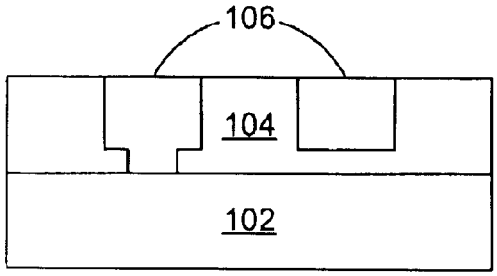
Figure 2:
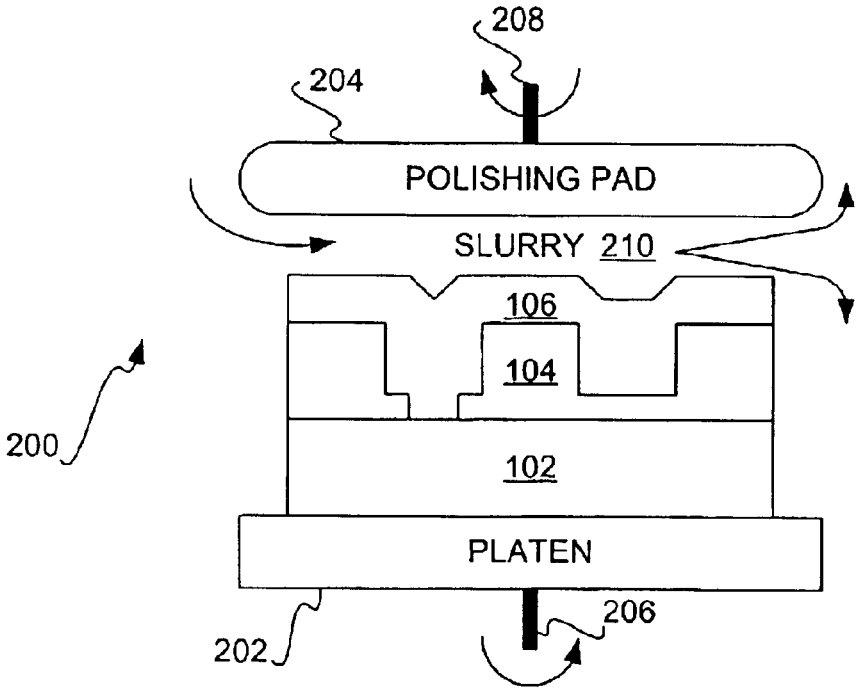
FIG. 2 is a diagram of an example of a CMP semiconductor fabrication system, in conjunction with which embodiments of the invention can be implemented.
Figure 3:
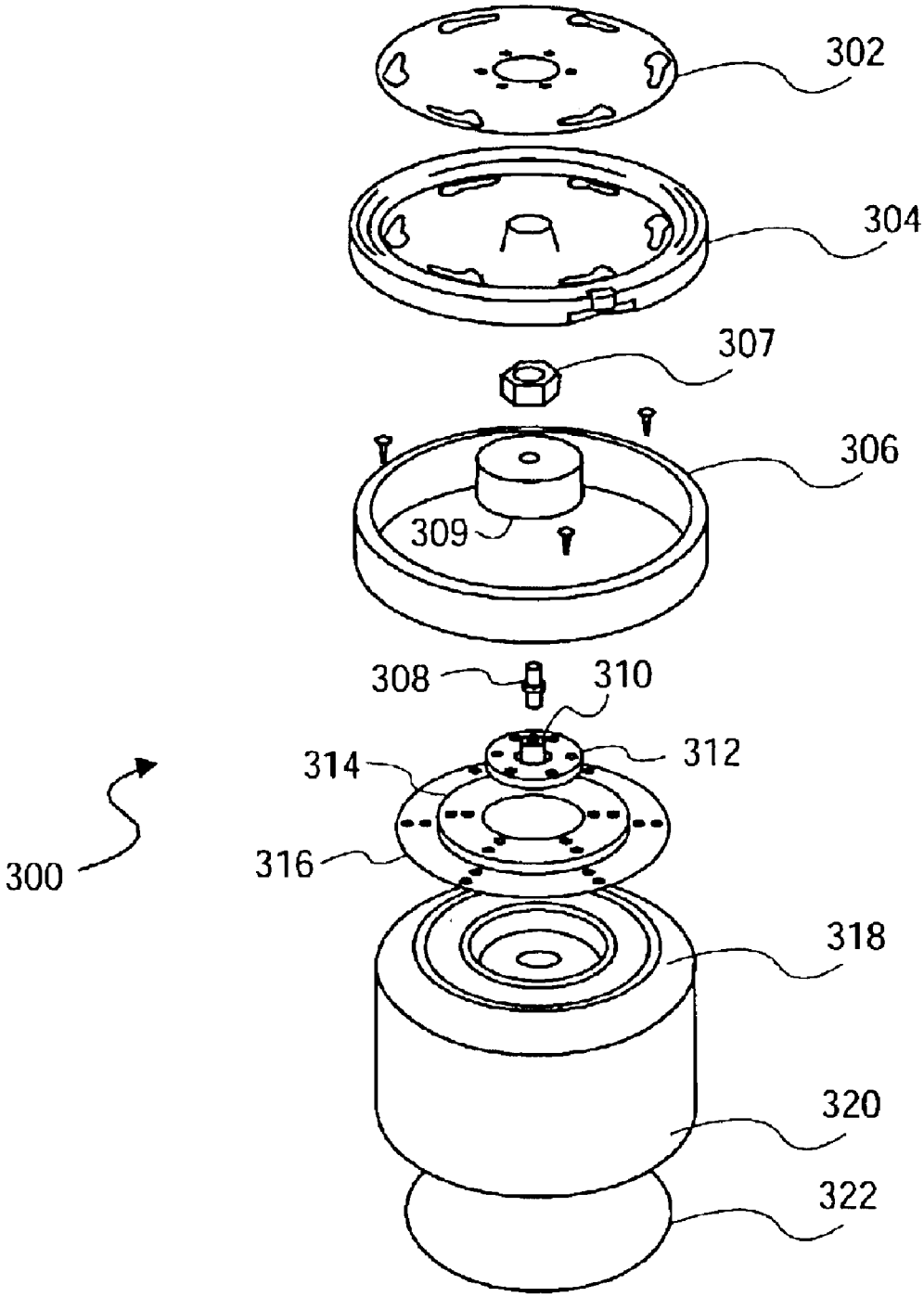
FIG. 3 is an exploded-view diagram of an example of a GMP tool, in conjunction with which embodiments of the invention can be implemented.
Figure 5:
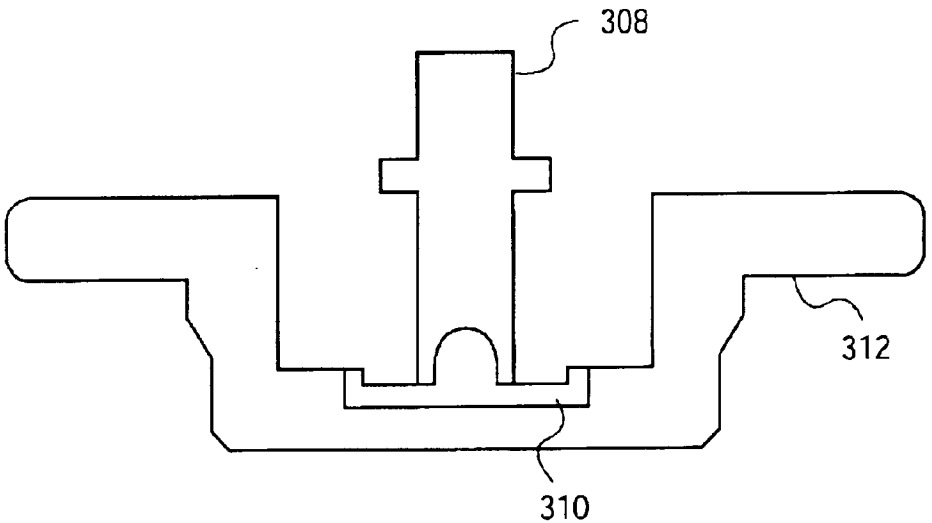
FIG. 5 is a side cross-sectional profile diagram of the gimbal assembly of the CMP tool of FIG. 3.
Figure 4:
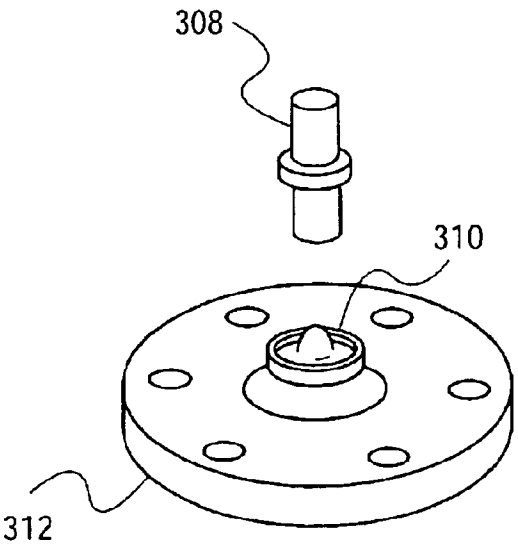
FIG. 4 is a perspective diagram of the gimbal assembly of the CMP tool of FIG. 3 in more detail.
Figure 7:
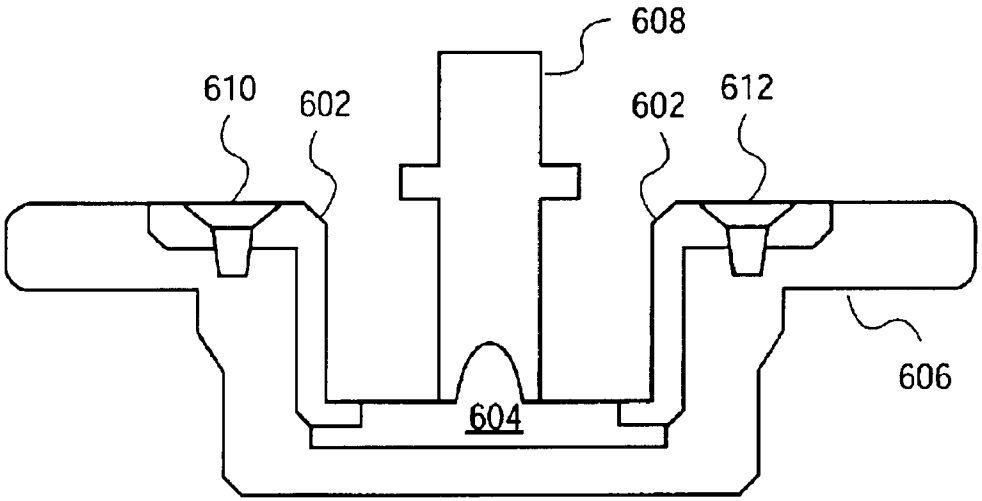
FIG. 7 is a side cross-sectional profile diagram of the gimbal assembly of FIG. 6, according to an embodiment of the invention.
Figure 6:
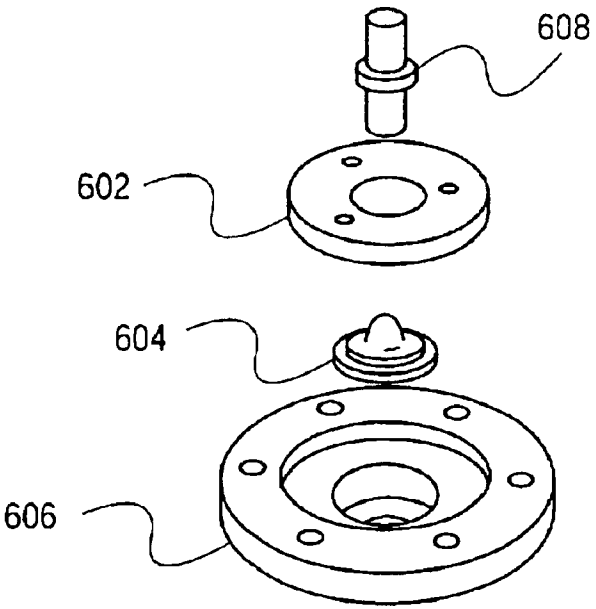
FIG. 6 is a perspective diagram of a gimbal assembly according to an embodiment of the invention, and that can be implemented in conjunction with the CMP tool of FIG. 3 and the CMP system of FIG. 2.

FIGS. 6 and 7 show in detail, as perspective and cross-sectional views, respectively, a gimbal assembly according to an embodiment of the invention. The gimbal assembly of FIGS. 6 and 7 can be used in conjunction with semiconductor fabrication tools, such as CMP tools, as well as other types of semiconductor fabrication tools and other types of tools altogether. The gimbal assembly includes a gimbal hub 606, a pivot head plate 604, a gimbal sleeve 602, and a gimbal post 608. The gimbal sleeve 602 may be constructed out of stainless steel. The pivot head plate 604 may be constructed out of polytetrafluoroethylene, such as that which is marketed and sold under the brand name Teflon.

As shown in FIGS. 6 and 7, the gimbal hub 606 has an interior cavity. The pivot head plate 604 has a ball head, a base, and an outer edge. The base of the pivot head plate 604 is situated at the bottom of the interior cavity of the gimbal hub 606. That is, the pivot head plate 604 is removably situated within the gimbal hub 606. The gimbal sleeve 602 is also situated in the bottom of the interior cavity of the gimbal hub 606, over the outer edge of the pivot head plate 604. This secures the pivot head plate 604 in place within the interior cavity of the gimbal hub 606. That is, the gimbal sleeve 602 secures the pivot head plate 604 within the gimbal hub 606. The gimbal post 608 is situated over the ball head of the pivot head plate 602.

In one embodiment, as is specifically shown in FIGS. 6 and 7, a number of screws, such as the screws 610 and 612 in FIG. 7, can be used to further secure gimbal sleeve 602 to the gimbal hub 606. This is accomplished by the screws being inserted and screwed into corresponding concentric holes of the gimbal sleeve 602 as well as the gimbal hub 606. More specifically, the intermediate shelf within the interior cavity of the gimbal hub 606 is where the screw holes of the gimbal hub 606 are located in the embodiment of the invention of FIGS. 6 and 7.

Figure 8:
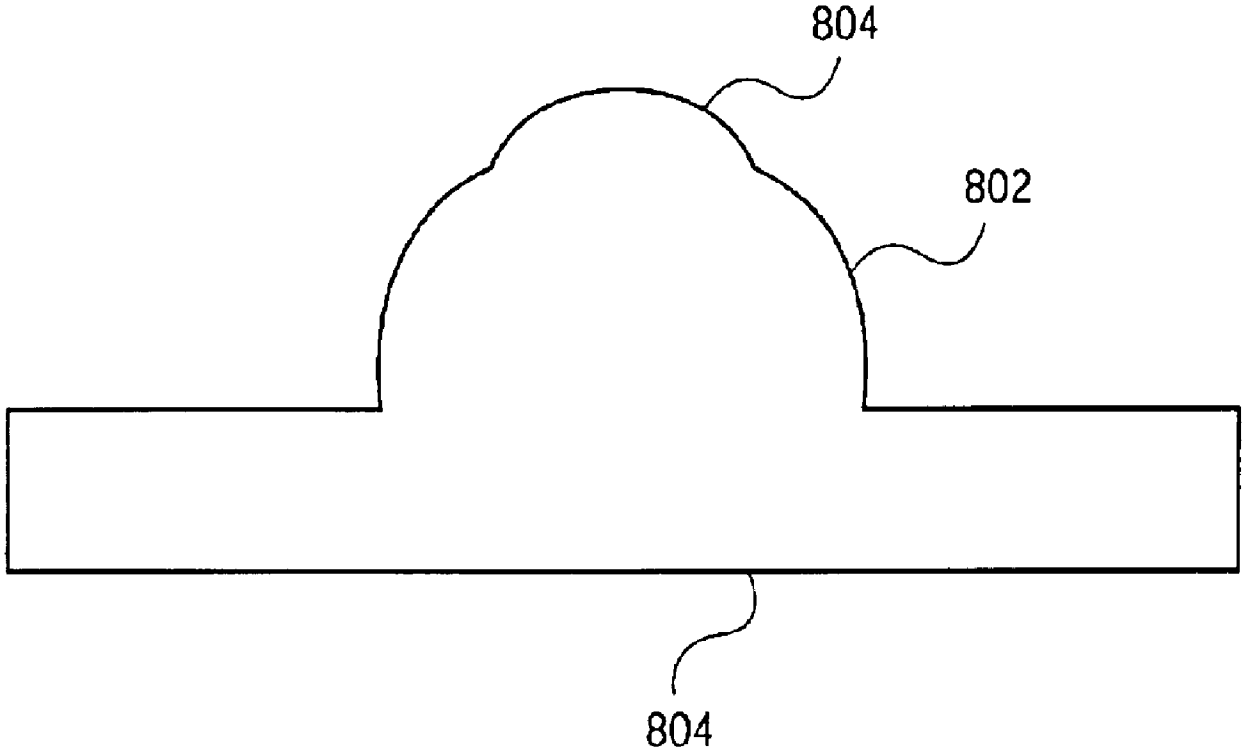
FIG. 8 is a diagram showing a dual-diameter pivot head of the pivot head plate of a gimbal assembly, according to an embodiment of the invention, and that can be implemented in conjunction with the gimbal assembly of FIGS. 6 and 7.

In FIG. 8, a specific embodiment of the pivot head plate 604 is shown. The pivot head plate 604 of FIG. 8 has a ball head that has two diameters, as indicated by the reference numbers 802 and 804. The dual-diameter ball head of the pivot head plate 604 of FIG. 8 promotes wider-angle movement of the tool of which the gimbal assembly incorporating the pivot head plate 604 of FIG. 8 is a part.

Thus, embodiments of the invention use a gimbal sleeve to prevent the pivot head plate from becoming loose from the gimbal hub. The gimbal sleeve can tightly press the pivot head plate to the gimbal hub, and can further be locked together, such as via screws as has been described. Preferably, the pivot head plate of an embodiment of the invention does not have a raised lip at its outer edge, so that it can more easily be plugged into the gimbal hub, also decreasing the potential for tilt to occur.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas the invention is substantially described in relation to a gimbal assembly for a semiconductor fabrication chemical-mechanical polishing (CMP) tool, it is applicable to other semiconductor fabrication tools, and other tools other than semiconductor fabrication tools, as well. Therefore, it is manifestly intended that this invention be limited only by the claims and equivalents thereof.

What is claimed is:

1. A gimbal assembly comprising:

a gimbal hub having an interior cavity and an intermediate shelf;

a pivot head plate having a ball head, a base, and an outer edge, the base situated in a bottom of the interior cavity of the gimbal hub;

a one-piece gimbal sleeve situated in the bottom of the interior cavity of the gimbal hub over the outer edge of the pivot head plate, securing the pivot head plate in place within the interior cavity of the gimbal hub, the gimbal sleeve directly contacting the intermediate shelf of the gimbal hub; and, a gimbal post situated over the ball head of the pivot head plate.

2. The gimbal assembly of claim 1, wherein the ball head of the pivot head plate has dual diameters.

3. The gimbal assembly of claim 1, wherein the pivot head plate is constructed from polytetrafluoroethylene.

4. The gimbal assembly of claim 1, wherein the gimbal sleeve is constructed from stainless steel.

5. The gimbal assembly of claim 1, further comprising a plurality of screws, the screws securing the gimbal sleeve to the gimbal hub via corresponding concentric screw holes of the gimbal sleeve and the gimbal hub.

6. The gimbal assembly of claim 1, further comprising a plurality of screws, the screws securing the gimbal sleeve to the gimbal hub via corresponding concentric screw holes of the gimbal sleeve and in the intermediate shelf of the gimbal hub.

7. A gimbal assembly comprising:

a gimbal hub having an intermediate shelf;

a pivot head plate having a ball head removably situated within the gimbal hub;

a one-piece gimbal sleeve situated in the gimbal hub such that the gimbal sleeve secures the pivot head plate within the gimbal hub, the gimbal sleeve directly contacting the intermediate shelf of the gimbal hub; and, a gimbal post situated over the ball head of the pivot head plate.

8. The gimbal assembly of claim 7, wherein the ball head of the pivot bead plate has dual diameters.

9. A The gimbal assembly of claim 7, wherein the pivot head plate is constructed from polytetrafluoroethylene.

10. The gimbal assembly of claim 7, wherein the gimbal sleeve is constructed from stainless steel.

11. The gimbal assembly of claim 7, wherein the pivot head plate has a base that is loosely situated in a bottom of an interior cavity of the gimbal hub.

12. The gimbal assembly of claim 11, wherein the gimbal sleeve is situated in the bottom of the interior cavity of the gimbal hub over an outer edge of the pivot head plate to secure the pivot head plate in place within the interior cavity of the gimbal hub.

13. The gimbal assembly of claim 7, further comprising a plurality of screws, the screws securing the gimbal sleeve to the gimbal hub via corresponding concentric screw holes of the gimbal sleeve and the gimbal hub.

14. A semiconductor fabrication tool comprising:

a gimbal hub having an intermediate shelf;

a pivot head plate having a ball head removably situated within the gimbal hub;

a one-piece gimbal sleeve situated in the gimbal hub such that the gimbal sleeve secures the pivot head plate within the gimbal hub, the gimbal sleeve directly contacting the intermediate shelf of the gimbal hub; and, a gimbal post situated over the ball head of the pivot head plate.

15. The semiconductor fabrication tool of claim 14, wherein the ball head of the pivot head plate has dual diameters.

16. The semiconductor fabrication tool of claim 14, wherein the pivot head plate has a base that is loosely situated in a bottom of an interior cavity of the gimbal hub.

17. The semiconductor fabrication tool of claim 14, wherein the gimbal sleeve is situated in the bottom of the interior cavity of the gimbal hub over an outer edge of the pivot head plate to secure the pivot head plate in place within the interior cavity of the gimbal hub.

18. The semiconductor fabrication tool of claim 14, wherein the semiconductor fabrication tool is a chemical-mechanical polishing (CMP) semiconductor fabrication tool.

19. The semiconductor fabrication tool of claim 18, further comprising:

a carrier head latch;

an assembly head in which the carrier head latch is positioned;

an outer assembly in which the assembly head is positioned;

a gimbal assembly including the gimbal hub, the pivot head plate, the gimbal sleeve, and the gimbal post;

a polishing head underneath the outer assembly, such that the gimbal assembly is positioned between the polishing head and the outer assembly; and, a retaining ring and a carrier film underneath the polishing head.

* * * * *